US005352320A

United States Patent [19]

Schwartz et al.

[11] Patent Number: 5,352,320

[45] Date of Patent: Oct. 4, 1994

[54] MANUAL TAPE DISPENSING APPARATUS

[75] Inventors: Mark E. Schwartz, Mahtomedi; James D. Ramacier, Hugo, both of Minn.; Robert A. Luhman, Deer Park, Wis.; Raymond D. Zachrison, Lindstrom, Minn.

[73] Assignee: Minnesota Mining and Manufacturing Company, Saint Paul, Minn.

[21] Appl. No.: 158,037

[22] Filed: Nov. 24, 1993

Related U.S. Application Data

[63] Continuation of Ser. No. 45,986, Apr. 9, 1993, abandoned.

[51] Int. Cl.[5] ..... B32B 31/00

[52] U.S. Cl. ..... 156/494; 156/495; 156/523; 156/577; 156/579; 53/441; 53/592

[58] Field of Search ..... 53/441, 580, 589, 592; 156/164; 229, 494, 495, 523, 527, 574, 577, 579

[56] References Cited

U.S. PATENT DOCUMENTS

| | | | |
|---|---|---|---|
| 2,023,147 | 12/1932 | Petskeyes | 93/2 |
| 2,909,301 | 10/1959 | Fritzinger | 156/494 |
| 2,972,843 | 2/1961 | De Broff | 53/74 |
| 3,839,122 | 10/1974 | Current et al. | 156/351 |
| 3,910,005 | 10/1975 | Thimon et al. | 53/3 |
| 3,930,442 | 1/1976 | Buttner | 100/18 |
| 4,050,221 | 9/1977 | Lancaster, III et al. | 53/211 |
| 4,095,395 | 6/1978 | Goldstein | 53/198 R |
| 4,109,445 | 8/1978 | Shulman | 53/198 R |
| 4,204,377 | 5/1980 | Lancaster et al. | 53/399 |

(List continued on next page.)

FOREIGN PATENT DOCUMENTS

| | | | |
|---|---|---|---|
| 0246659A1 | 11/1987 | European Pat. Off. | B65B 11/04 |
| 0433718A1 | 6/1991 | European Pat. Off. | B65B 11/02 |
| 3200220A1 | 7/1983 | Fed. Rep. of Germany | B65B 61/00 |
| 3409117A1 | 9/1985 | Fed. Rep. of Germany | B65B 61/00 |
| 2083002A | 3/1982 | United Kingdom | B65B 11/04 |

OTHER PUBLICATIONS

Translation of an article from the German Trade Journal PACK REPORT, May 1991, pp. 98–99.

3M Brochure 75-3465-9433-8 "Stretch Laminator" Rand Brochure.

*Primary Examiner*—David A. Simmons

*Assistant Examiner*—James J. Engel, Jr.

*Attorney, Agent, or Firm*—Gary L. Griswold; Walter N. Kirn; Mark W. Binder

[57] ABSTRACT

The present invention is a portable manual tape dispensing apparatus for use with a stretchable adhesive tape such as of the type that progressively detackifies when stretched. The apparatus has a supply spool for carrying a supply of the tape and a handle connected to the supply spool for manually grasping and manipulating the apparatus. A mechanism for stretching the tape is arranged and configured to receive the tape from the supply spool. The stretching mechanism has a stretching zone defined between first and second engagement surfaces. The first and second engagement surfaces frictionally engage the tape and move at disparate longitudinal speeds to stretch the tape when the stretching mechanism is activated. A manually operative mechanism is provided for selectively activating the stretching mechanism so an operator can remove the tape from the supply in a substantially detackified stretched condition when the stretching mechanism is activated. The manually operative mechanism also permits the operator to remove the tape from the supply in an unstretched condition.

20 Claims, 8 Drawing Sheets

U.S. PATENT DOCUMENTS

| | | | |
|---|---|---|---|
| 4,209,961 | 7/1980 | Dannelley | 53/588 |
| 4,230,519 | 10/1980 | DuBroff | 156/468 |
| 4,235,062 | 11/1980 | Lancaster, III et al. | 53/399 |
| 4,255,918 | 3/1981 | Lancaster et al. | 53/556 |
| 4,271,657 | 6/1981 | Lancaster, III et al. | 53/399 |
| 4,364,787 | 12/1982 | Radzins | 156/495 X |
| 4,369,614 | 1/1983 | Tetzner | 53/556 |
| 4,429,514 | 2/1984 | Lancaster et al. | 53/556 |
| 4,432,185 | 2/1984 | Geisinger | 53/138 R |
| 4,458,467 | 7/1984 | Shulman et al. | 53/399 |
| 4,549,388 | 10/1985 | Lancaster | 53/556 |
| 4,563,863 | 1/1986 | Humphrey | 53/556 |
| 4,671,043 | 6/1987 | Forni et al. | 53/399 |
| 4,676,048 | 6/1987 | Lancaster et al. | 53/399 |
| 4,693,060 | 9/1987 | Born | 53/588 |
| 4,807,427 | 2/1989 | Casteel et al. | 53/556 |
| 4,845,920 | 7/1989 | Lancaster | 53/399 |
| 4,884,385 | 12/1989 | Mushinski et al. | 53/399 |
| 4,905,451 | 3/1990 | Jaconelli et al. | 53/410 |
| 4,905,455 | 3/1990 | Horner | 53/441 |
| 4,915,767 | 4/1990 | Rajala et al. | 156/164 X |
| 4,955,181 | 9/1990 | Casteel | 53/556 |
| 4,991,381 | 2/1991 | Simons | 53/556 |
| 4,995,224 | 2/1991 | Yourgalite et al. | 53/540 |
| 5,003,752 | 4/1991 | Matsumoto | 53/399 |
| 5,040,358 | 8/1991 | Thimon | 53/556 |
| 5,216,871 | 6/1993 | Hannen | 53/556 |

MANUAL TAPE DISPENSING APPARATUS

This is a continuation of application Ser. No. 08/045,986 filed Apr. 9, 1993, now abandoned.

REFERENCE TO CO-PENDING APPLICATION

Reference is made to patent application (Ser. No. 08/044,950) entitled MANUAL TAPE DISPENSING APPARATUS filed on even date herewith.

BACKGROUND OF THE INVENTION

This invention relates to a tape dispensing device and more specifically, to a manual, portable dispensing apparatus for use with a roll of stretchable adhesive tape.

A number of manufacturing and distribution settings typically require that packages or products be grouped together to facilitate the handling, loading, shipping and storage of the packages or products. The grouping of these products is commonly known as "unitizing".

There are a number of methods which unitize products. One such method is palletization, which generally involves placing a number of boxed items on a pallet in a cube or other rectangular array. Normally the array of boxed items are strapped or wrapped to the pallet to ensure the lateral stability of the array during the shipping and loading of the pallet. "Bundling" is another unitizing method which generally involves strapping or wrapping a number of products together. A number of other unitizing methods also require the use of either a strapping or wrapping material.

Recently an adhesive tape was developed to provide an efficient way to strap products and packages. A description of this adhesive tape is provided in Assignee's co-pending U.S. application Ser. No. 07/802,061, filed Dec. 10, 1992, which is a continuation-in-part of Assignee's abandoned U.S. application Ser. No. 07/632,173, filed Dec. 20, 1990; Assignee's co-pending U.S. application Ser. No. 07/731,341, filed on Jul. 19, 1991; and Assignee's co-pending U.S. application Ser. No. 07/892,220, filed on Jun. 2, 1992, all of which are fully incorporated herein by reference thereto. The adhesive tape is stretchable and is comprised of a highly extensible, substantially non-recoverable backing which has a layer of pressure sensitive adhesive on at least one of its surfaces. The pressure sensitive adhesive has sufficient shear strength and adhesive holding power to adhere to small regions of the objects to which the unstretched tape is attached. This adhesive property of the tape, however, is greatly reduced when the tape is stretched or elongated to several times its original length, for example 600–800%. Essentially the tape becomes "detackified" when the tape is elongated. This detackification is beneficial because it greatly reduces the damage that the adhesive could cause to an object surrounded by the tape when the tape is removed from the object.

The elongation of the tape provides other important benefits beyond inducing detackification. First, the tensile strength of the tape increases when the tape is elongated. Accordingly, the tape can be used in strapping methods which require a high tensile strength strap. Secondly, the elongation of the tape reduces the quantity of tape that is needed for a given unitizing application, thereby reducing the cost of each application. Furthermore, the amount of material which must be recycled or placed in a landfill is also reduced.

The stretchable adhesive tape has proven to be useful in a variety of unitizing procedures. For example, the tape can easily be incorporated to strap an array of objects on a pallet. First, an unstretched tackified portion of the tape is applied to a first object. Once secured, the tape is stretched to induce detackification and wrapped around the remaining objects. Finally, a portion of unstretched tape is adhered to an object in the group to anchor the stretched detackified tape. As applied above, the tape provides stability to the objects during the shipping and handling of the pallet. The tape can easily be removed from the pallet when the pallet reaches it's destination by merely releasing the adhering port one of the tape from the object(s). A more detailed description of a palletization method like the one described above is provided in Assignee's above-referenced co-pending U.S. application Ser. No. 07/731,341, filed on Jul. 19, 1991.

A detailed description of an automatic machine that utilizes the stretchable adhesive tape to palletize objects is disclosed in Assignee's above-referenced co-pending U.S. application Ser. No. 07/892,220, filed on Jun. 2, 1992. The unitizing machine has a rotating turntable upon which an array of objects are stacked. A taping head is located adjacent the turntable and is connected to a vertical movement means such that the taping head can be moved vertically with respect to the array of objects. The taping head advances the tape through a stretch station and feeds the tape to the array of objects. A programmable controller simultaneously controls, among other things, the amount of stretch performed by the taping head, the vertical motion of the taping head, and the rotation of the turntable to palletize the array of objects.

The automatic machine, however, is not readily portable and cannot be manually manipulated tow rap a variety of objects. Accordingly, it may be difficult to utilize the automatic machine in a number of unitizing procedures. In addition, the automatic machine may be prohibitively expensive for a user that performs a relatively small number of palletization procedures.

There are a number of other devices that dispense materials in a stretched condition. U.S. Pat. No. 4,429,514 to Lancaster et al. discloses one such device designed in part to stretch a film of material used in a wrapping process. In Lancaster et al., object(s) are placed within the confines of an apparatus and an arm is vertically revolved around the object(s). An upstream roller, a downstream roller, and a drive member are attached to the arm. The arm has a manual gravity switch that includes a spring to bias the downstream roller member together with the drive member when the arm is rotating vertically upward around the object(s). The upstream roller is driven at a slower speed than the downstream roller when the downstream roller is biased against the drive member. Therefore, the film is stretched between the downstream roller and the upstream roller when the arm is rotated vertically upward. The film is stretched so that it places a compressive force upon the object(s) contained in the film.

The stretch film usable with the device in Lancaster et al. is designed to completely wrap or "cocoon" objects, whereas stretchable adhesive tape contacts discreet portions of each object. Accordingly, a stretch film unitizing procedure requires the use of a substantial amount of material. In addition, separate means for adhering the stretch film to the object is required because the stretch film has no inherent adhesive means.

In addition, the device of Lancaster et al. is not readily portable and is somewhat cumbersome to use.

Stretchable adhesive tape can be utilized in a large variety of packaging procedures. Therefore, it can be seen that there is a need for a portable manual tape dispensing apparatus for use with a stretchable adhesive tape that detackifies when stretched. The apparatus should be sufficiently small and easy to use to enable an operator to manipulate the apparatus about a variety of packages or objects.

SUMMARY OF THE INVENTION

The present invention is a portable manual tape dispensing apparatus for use with a stretchable adhesive tape that progressively detackifies when stretched. The apparatus has a supply spool for carrying a supply of the tape and a handle connected to the supply spool for manually grasping and manipulating the apparatus. A mechanism for stretching the tape is arranged and configured to receive the tape from the supply spool. The stretching mechanism has a stretching zone defined between first and second engagement surfaces. The first and second engagement surfaces frictionally engage the tape and move at disparate longitudinal speeds to stretch the tape when the stretching mechanism is activated. A manually operative mechanism is provided for selectively activating the stretching mechanism so an operator can remove the tape from the supply in a substantially stretched condition when the stretching mechanism is activated. The manually operative mechanism also permits the operator to remove the tape from the supply in a unstretched condition.

In one embodiment, the first and second engagement surfaces are disposed on first and second cylindrical rollers respectively. A first gear is coupled to the first roller and is selectively engagable with a second gear that is coupled to the second roller, such as by movably mounting one or both of the first and second gears. Preferably, the first gear and roller are pivotally mounted to be movable between engaged and disengaged positions. A lever mechanism for selectively engaging the first and second gears is provided. The first and second rollers are preferably of different diameters and rotate at disparate rotational speeds, such that the engagement surfaces rotate at disparate longitudinal speeds when the first and second gears are engaged with one another. The disparate longitudinal speeds between the engagement surfaces can also be obtained by varying the diameters of the rollers and/or the rotational speed of the rollers.

In another embodiment, the first and second engagement surfaces are disposed on first and second rollers respectively. The first roller normally engages with a first gear surface. The second roller is coupled to a second gear surface. A transfer member, such as a belt, connects the first gear surface and the second gear surface so that the first engagement surface rotates relative to the second engagement surface. As an alternative to the engagement and disengagement of movable gears as set out in the first embodiment above, the coupling between either one or both of the first and second gears to the first and second rollers, respectively, can be selectively uncoupled to provide a similar result. To do this, a clutch assembly is preferably provided for selectively engaging and disengaging the first roller and the first gear surface so the first and second rollers can rotate together by the transfer member when the clutch is activated or independently when the clutch is deactivated. When the first roller and the second roller rotate independently, the stretching mechanism is deactivated.

In still another embodiment, the first and second engagement surfaces are disposed on first and second rollers, respectively. The first roller is coupled to a first gear which is engaged with a second gear that is coupled to the second roller. With this particular embodiment, the operator can selectively manually activate and deactivate the stretching mechanism by changing the orientation of the dispensing apparatus so that the tape is frictionally engaged with both of the tape engagement surfaces to provide tape stretching and only one of the tape engagement surfaces for dispensing the tape in its unstretched condition. Thus, with this alternative, there is no need to disengage either the first and second gear from each other or one of the first and second gear from its respective roller.

It is evident that the stretchable adhesive tape can be utilized in a number of packaging and unitizing procedures. The present invention provides a dispensing apparatus which can utilize the tape in a number of applications. The apparatus is portable and sufficiently small to enable an operator to manipulate the apparatus by using the operator's hands. The apparatus provides a manually operative mechanism for selectively stretching the tape. The tape dispenser of the present invention can stretch the tape at any elongation rate limited by the ability of the tape to stretch and preferably in the range of 600 to 800 percent to obtain ideal tape characteristics of resiliency, tensile strength, and detackification.

DETAILED DESCRIPTION OF THE PREFERRED EMBODIMENTS

Figure 1:
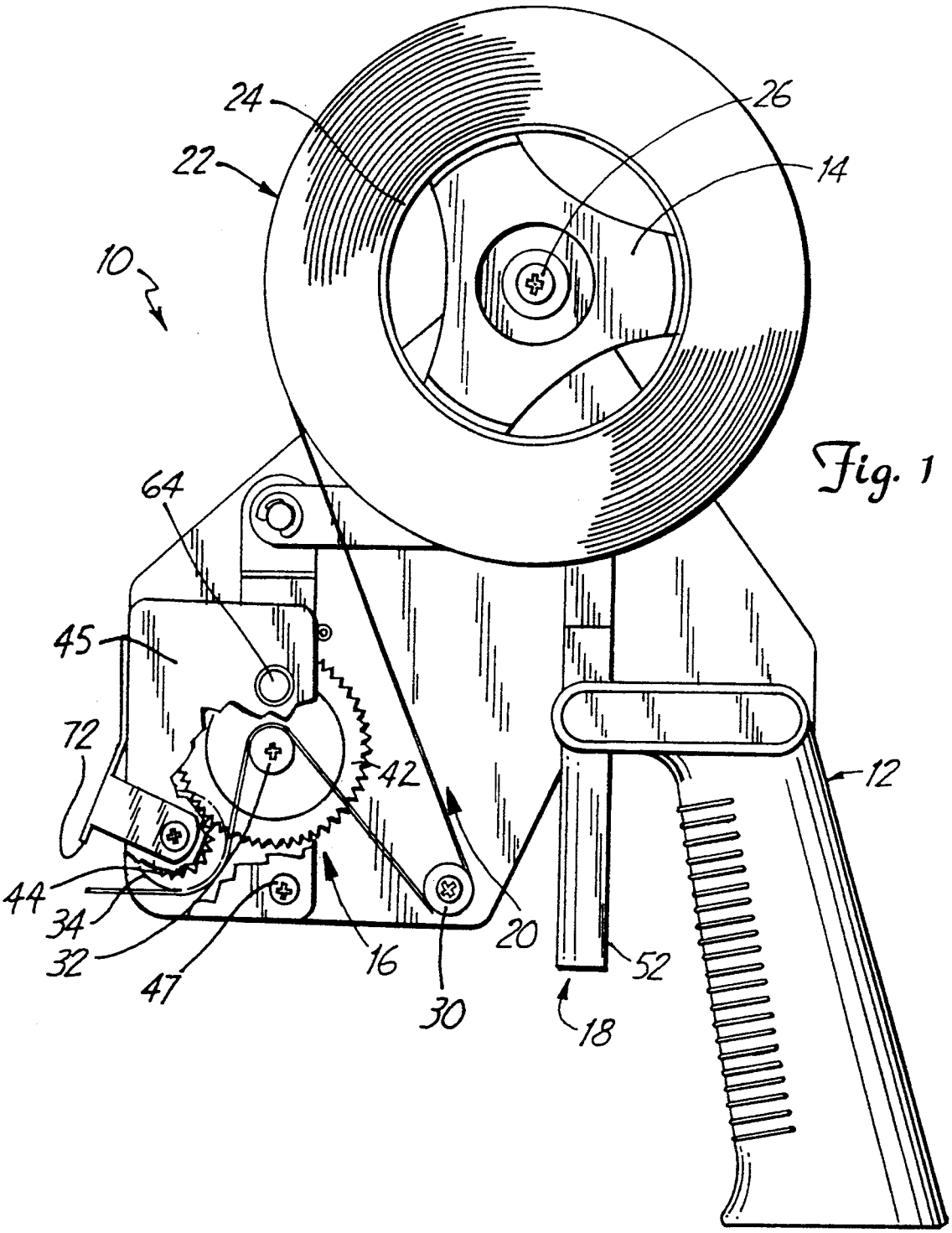
FIG. 1 is a side elevational view of the present invention with a portion of the apparatus broken away.

FIG. 1 shows one preferred embodiment of a portable tape dispensing apparatus 10. The apparatus 10 has a handle 12, a supply spool 14, a stretching mechanism 16 (seen more clearly in FIGS. 2 and 3), and a manual activation mechanism 18 (seen more clearly in FIG. 5), all interconnected by a base plate 20.

The supply spool 14 rotates about a cylindrical surface and is connected to the base plate 20 by a supply spool screw 26. The supply spool 14 is adapted to receive and hold a roll of stretchable adhesive tape 22. The tape 22 preferably of the type that detackifies when stretched along its longitudinal extent. The roll of tape 22 typically has an interior cylindrical member 24 comprised of a generally cardboard-like material. The supply spool 14 frictionally holds the roll of tape 22 in position when an operator manipulates the dispensing apparatus 10.

The tape 22 is entrained over an idle roller 30, a first roller 32 and a second roller 34. The first roller 32 and the second roller 34 are disposed between and pivotally supported in position by a roller plate 45 and the base plate 20. The roller plate 45 provides structural integrity to the apparatus 10 and is firmly attached to the base plate 20 through a roller plate support column 67 (see FIG. 5) by a roller plate screw 47.

Figure 2:
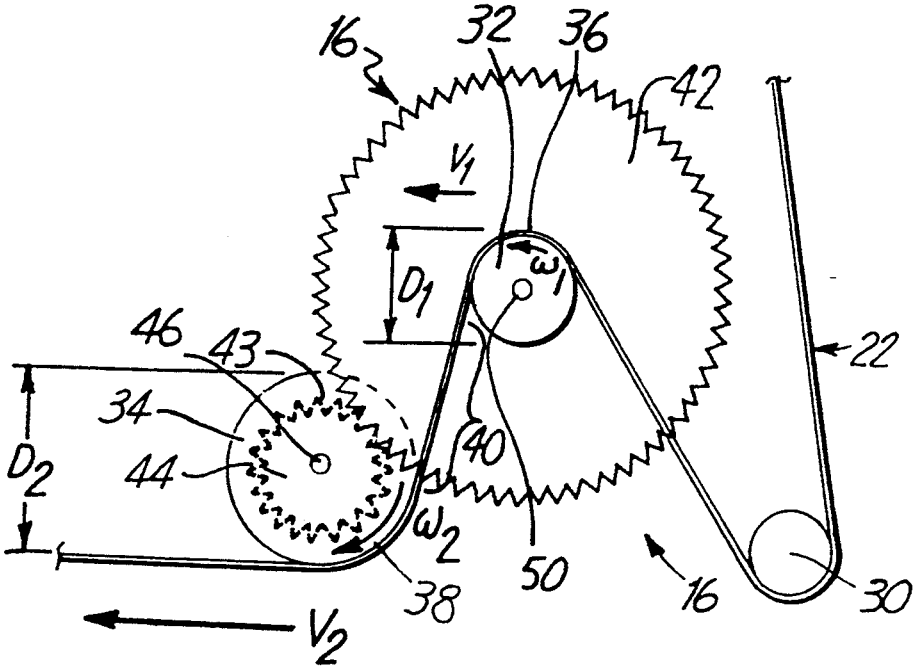
FIG. 2 is an enlarged side elevational view showing the stretching mechanism of the present invention in an engaged position.
Figure 3:
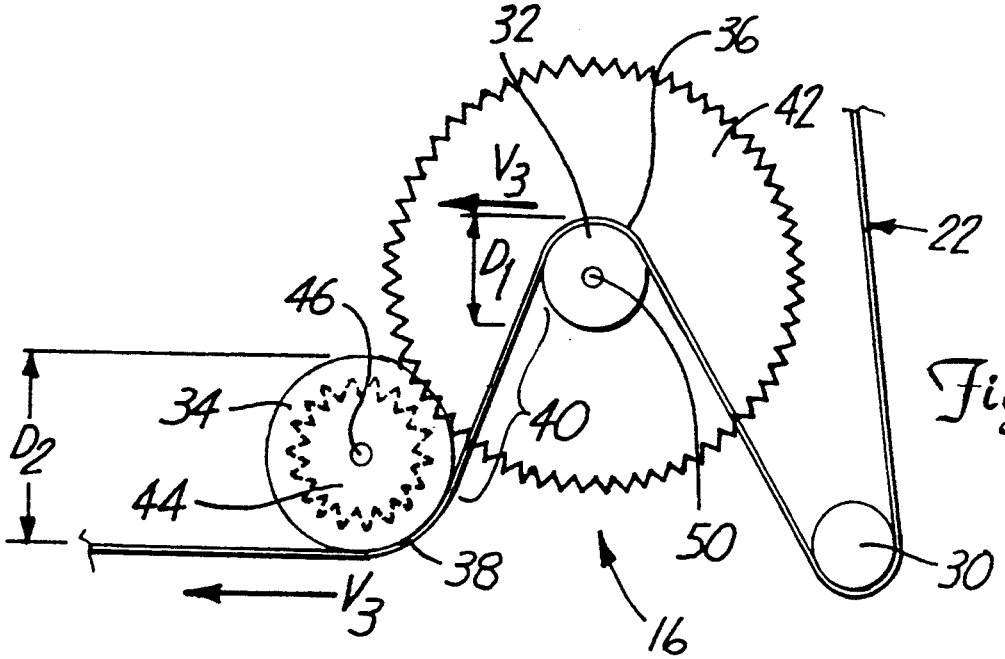
FIG. 3 is an enlarged side elevational view of the stretching mechanism of the present invention in a disengaged position.

FIGS. 2 and 3 more clearly show the tape 22 as it extends through the stretching mechanism 16. The tape 22 first passes over the idle roller 30 positioned on the base plate 20. Next, the tape 22 frictionally engages a first engagement surface 36 disposed on the first roller 32 and then a second engagement surface 38 disposed on the second roller 34. The area extending between the first engagement surface 36 and the second engagement surface 38 defines a stretching zone 40. If the tape 22 is of the type that has an adhesive on only one side, the level of frictional engagement that occurs between the tape 22 and the first engagement surface 36 is increased due to the pressure of the adhesive. The level of frictional engagement between the tape 22 and the second engagement surface 38 is not affected by the adhesive. The engagement surfaces 36 and 38 are preferably designed in order to provide sufficient frictional contact with the tape to minimize slippage between the engagement surfaces 36 and 38 and the tape to control the amount of stretching. Thus, the elongation of the tape 22 in the stretching zone 40 is most largely effected by creating disparate longitudinal speeds between the first engagement surface 36 and the second engagement surface 38.

As seen best in FIGS. 2 and 3, the stretching mechanism 16 includes a first gear 42 and a second gear 44 to create disparate longitudinal surface speeds V1 and V2 of the first engagement surface 36 and the second engagement surface 38, respectively. The first gear 42 is connected to the first roller 32. The first roller 32 and the first gear 42 are rotatably mounted to an activation bracket 48 (see FIG. 5) by a first roller pin 50. The second gear 44 is connected to the second roller 34 to rotate therewith. The second roller 34 and the second gear 44 are rotatably mounted to the base plate 20 and the roller plate 45 by a second roller pin 46. As seen in FIG. 2, the stretching mechanism is activated, that is, the first gear 42 and the second gear 44 are engaged with each other, so that rotation of either one of the first roller 32 and the second roller 34 drives the other.

The tape 22 frictionally drives the rollers 32 and 34 as the tape 22 is pulled through the apparatus. Accordingly, since the first gear 42 is larger than the second gear 44, the first roller 32 will rotate at a first rotational speed $\omega_1$ and the second roller 34 will rotate at a higher second rotational speed $\omega_2$. The first roller 32 has a first diameter $D_1$ and the second roller 34 has a second larger diameter $D_2$. The longitudinal speeds V1 and V2 are determined by the following equation:

$$V=\pi\times D\times\omega$$

where $\pi=3.14$,

D=the diameter of the roller, and $\omega$=revolutions per second.

Figure 4:
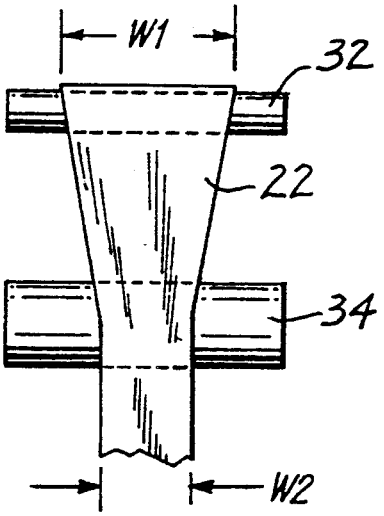
FIG. 4 is a plan view of the stretching mechanism of the present invention.

Therefore, the longitudinal velocity V2 of the second roller 34 will be greater than the longitudinal velocity V1 of the first roller since the diameter D2 and the rotational speed $\omega_2$ of the second roller are both greater than the diameter $D_1$ and the rotational speed $\omega_1$ of the first roller. Accordingly, as seen more clearly in FIG. 4, the tape 22 will become stretched such that it has a first width W1 as it enters the stretching zone 40 and a second width W2 as it exits the stretching zone 40.

The amount of stretch or elongation of the tape 22 as it passes through the stretching zone 40 is dependent upon the difference of the longitudinal velocities and any slippage that may occur as a result of the amount of frictional engagement between the tape 22 and the engagement surfaces 36 and 38. The amount of frictional engagement depends in part upon the material used to construct the rollers 32 and 34, the size of the engagement surfaces 36 and 38, and whether the tackified side of the tape 22 contacts the engagement surfaces 36 and 38. Preferably, the disparate longitudinal velocities and the amount of frictional engagement are adjusted such that the tape is stretched approximately between 600–800% when using a tape. This particular range of elongation provides the best characteristics of resiliency, tensile strength, and detackification of the tape described in Assignee's above-referenced co-pending U.S. Applications. It has been found that the following dimensions when incorporated in the above embodiment can obtain the preferred stretch ratio when the rollers are comprised of a hard plastic material: $D_1=0.5$ inches, (1.27 cm) $D_2=1.0$ inches, (2.54 cm) the first gear 42 has 56 teeth, and the second gear 44 has 16 teeth.

FIG. 2 shows the first gear 42 and the second gear 44 in their normal engaged position. When the first gear 42 and the second gear 44 are engaged, the stretching mechanism is activated. FIG. 3 shows the relative position of the first gear 42 and the second gear 44 when the stretching mechanism 16 is deactivated. When the first gear 42 and the second gear 44 are disengaged, the first roller 32 and the second roller 34 rotate freely such that the first engagement surface 36 and the second engagement surface 38 have the same longitudinal velocity V3 when the tape 22 is pulled through apparatus 10. Accordingly, minimal stretching will occur when the tape 22 is dispensed from the apparatus 10.

Figure 5:
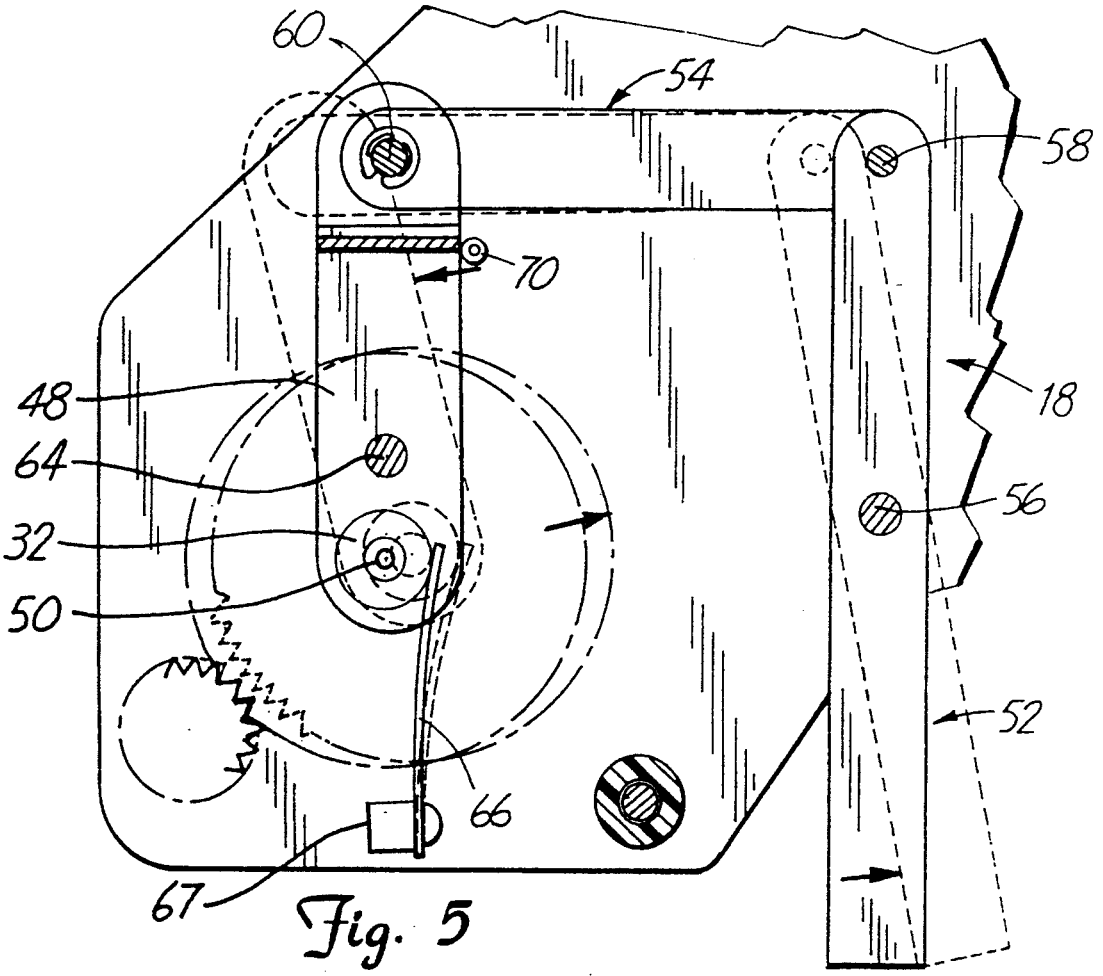
FIG. 5 is an enlarged side elevational view of the present invention showing the manual activation means of the present invention.

FIG. 5 more clearly shows one possible manual activation mechanism 18 that is provided for selectively activating and deactivating the stretching mechanism 16. It is contemplated that any mechanism that moves one or both of the gears 42 and 44 relative to each other could be utilized. The manual activation mechanism 18 is shown in its normal activated position (solid lines) and in its deactivated position (dashed lines). With this preferred embodiment, the manual activation mechanism 18 includes a lever arm 52, a transition arm 54 and the activation bracket 48. The lever arm 52 is pivotally mounted to the handle 12 at pivot point 56. The transition arm 54 is pivotally connected to the lever arm 52 at pivot point 58 and to the activation bracket 48 at pivot point 60. The activation bracket 48 is pivotally connected to the base plate 20 and roller plate 45 at pivot point 64. A biasing member 66, such as a resilient metal strip, is attached to the roller plate support column 67 disposed beneath the first roller 32. The biasing member 66, biases the first roller 32, so that the first gear 42 and the second gear 44 are normally engaged. A stop pin 70 may also be provided as positioned on the base plate 20 such that the activation bracket 48 presses against the stop pin 70 when the first gear 42 and the second gear 44 are engaged. Any other biasing means for urging the engagement of the gears 42 and 44 can be used, such as a torsional spring acting against the bracket 48 provided about the pivot 64.

As seen in FIG. 5, an operator can deactivate the stretching means 16 by grasping the lever arm 52 and pulling the lever arm 52 toward the handle 12. Pulling the lever arm 52 causes the activation bracket 48 to pivot about pivot point 64 such that the first gear 42 becomes disengaged from the second gear 44.

The above embodiment provides a simple means for effectively utilizing the stretchable adhesive tape 22 in a variety of unitizing procedures. To utilize the apparatus, the operator may first remove a portion of tape in an unstretched condition by pulling the lever arm 52 to disengage the gears 42 and 44. The operator then affixes the portion of tape that is unstretched to an object or objects. After affixing the tape to the object, the operator then activates the stretching means 16 by releasing the lever arm 52. The operator can then dispense the tape 22 from the apparatus 10 in a stretched, condition. After wrapping the stretched, portion of the tape about an object or objects, the operator may remove a portion of unstretched tape by pulling the lever arm 52 to deactivate the stretching means. A cutting member 72 (see FIG. 1) is also preferably disposed adjacent the second roller 34 so that an operator may cut the tape 22 after dispensing a sufficient amount of unstretched tape from the apparatus 10. The operator may then adhere the unstretched portion of tape to an object or objects to complete the unitizing procedure.

Figure 6:
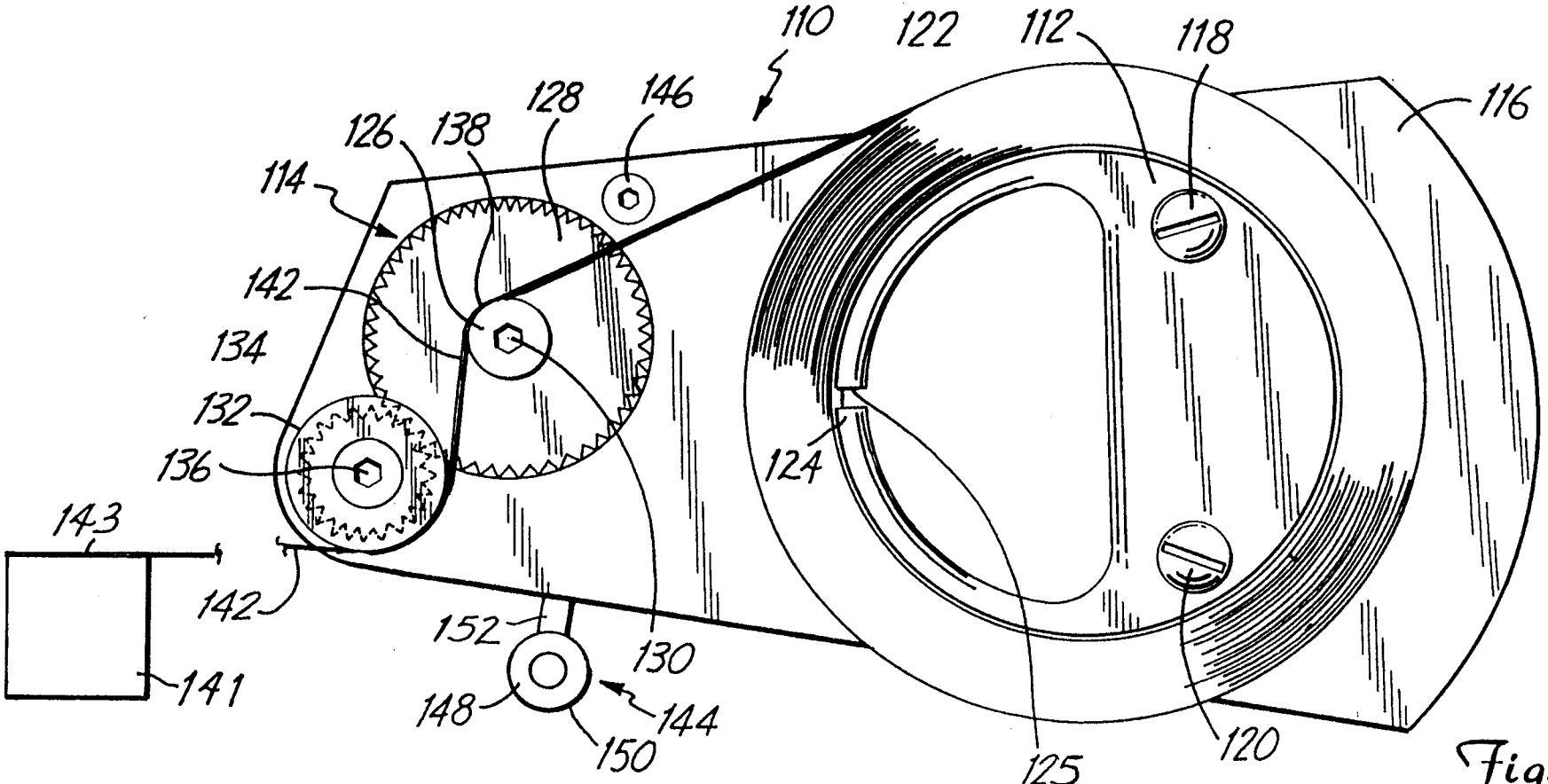
FIG. 6 is a side elevational view of an alternative embodiment of the present invention in its stretching position.
Figure 7:
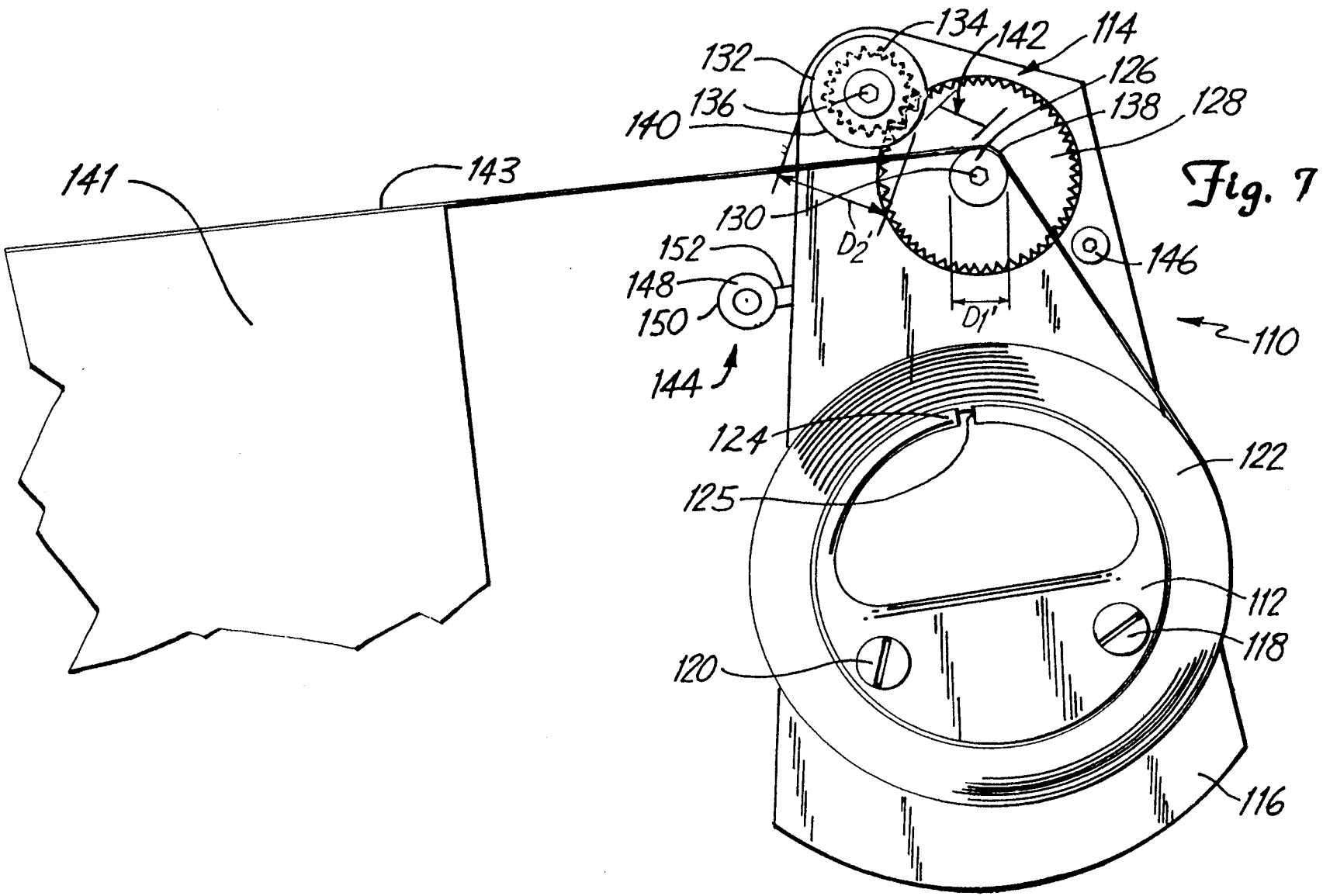
FIG. 7 is a side elevational view of the alternative embodiment of the present invention shown in FIG. 6 in its non-stretching position.
Figure 8:
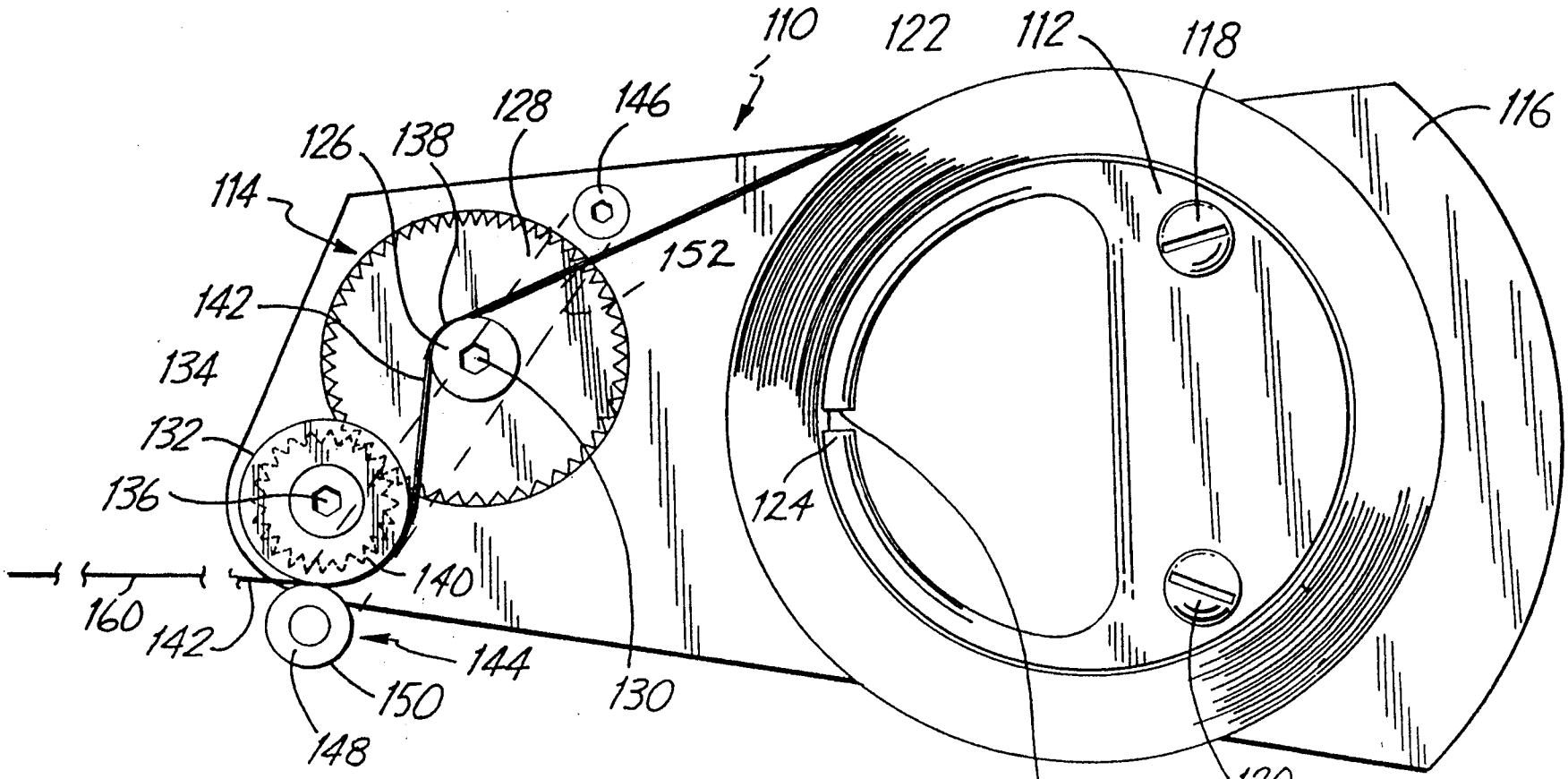
FIG. 8 is a side elevational view of the alternative embodiment of the present invention shown in FIG. 6 with a cutting member in its cutting orientation.

FIGS. 6–8 show an alternative embodiment of the present invention. FIG. 6 shows a dispensing apparatus 110 having a resilient handle member 112 and a stretching mechanism 114 interconnected by a base plate 116. The handle member 112 is attached to the base plate 116 by handle screws 118 and 120. The resilient handle member 112 has a cutout section 125 that allows the handle member 112 to be flexed by manual manipulation so that the handle member 112 can be slidably received within and removed from a roll of stretchable adhesive tape 122. A ridge 124 is preferably disposed about the circumference of the handle member 112 in order to prevent the roll of tape 122 from being inadvertently laterally removed from the handle member 112. Normally the handle member 112 is configured such that the roll of tape 122 rotates relatively freely about the handle member 112.

The stretching mechanism 114 includes a first roller 126 connected to a first gear 128. The first roller 126 and the first gear 128 are rotatably mounted to the base plate 116 by a first roller pin 130. A second roller 132 is connected to a second gear 134. The second roller 132 and the second gear 134 are rotatably mounted to the base plate 116 by a second roller pin 136 so the first gear 128 and the second gear 134 are maintained in engagement with each other. Accordingly, the first roller 126 rotates relative to the second roller 132.

A first engagement surface 138 and a second engagement surface 140 are disposed on the first roller 126 and the second roller 132, respectively. As seen in FIG. 6, the tape 122 is entrained over the rollers 126 and 132 and extends distally from the apparatus 110. A leading portion of unstretched tape 143 is illustrated as being adhered to an object 141 (not necessarily shown in scale). The area extending between the first engagement surface 138 and the second engagement surface 140 defines a stretching zone 142. The stretching mechanism 114 functions in the same way as the stretching mechanism 16 presented in FIGS. 1–5. Accordingly, the tape 122 will drive the rollers 126 and 132 so that the first engagement surface has a first longitudinal velocity V1' and the second engagement surface 140 has a second greater longitudinal velocity V2'. Therefore, the tape 122 disposed within the stretching zone 142 will become elongated as a result of the disparate longitudinal speeds V1' and V2'. As stated before, the disparate longitudinal speeds V1' and V2' should be such that the tape is elongated in the range of 600% to 800%. It has been found that the following dimensions, when incorporated in the above embodiment, provide the preferred amount of stretch when the rollers are comprised of a hard plastic material: $D_1 = = 1.0$ inches, (2.54 cm) $D_2 = 0.5$ inches, (1.27 cm) the first gear 128 has 42 teeth, and the second gear 134 has 15 teeth.

FIGS. 6 and 7 show how an operator may manually activate and deactivate the stretching mechanism 114. To deactivate the stretching mechanism 114, the operator manually rotates the apparatus from the position shown in FIG. 6 so that the tape 122 becomes disengaged from the second engagement surface 140 as seen in FIG. 7. The amount of manual rotation of the apparatus 110 necessary to deactivate or activate the stretching mechanism 114 can vary depending upon the relative positions of the first roller 126 and the second roller 132. The amount of manual rotation should be such that the operator can easily activate and deactivate the stretching mechanism. In the illustrated embodiment, a rotation of the apparatus about the roller pin 136 of about 90° is required to activate and deactivate the stretching mechanism 114. Thus, upon deactivation, contact of the tape 122 with roller 126 causes rotation of the rollers 126 and 132 during dispensing, but no substantial stretching occurs since the tape 122 does not contact the second engagement surface 140.

A cutting means may further be provided and may comprise a fixed blade, a movable blade or the like, or any other conventional cutting device. In accordance with a preferred embodiment, a cutting member 144 is pivotally attached to the base plate 116 at point 146. The cutting member 144 preferably comprises a generally cylindrical member 148 with a structured exterior surface 150, such as a knurled surface, attached to a pivot arm 152. As seen in FIG. 8, the pivot arm 152 allows the operator to selectively press the member 148 against the second roller 132. Moreover, the member 148 provides a line contact, or more accurately a line of point contacts when using a structured surface such as knurling, with the tape 122 over the width of the tape 122. The operator can generate substantial friction between the tape 122 and the second engagement surface 140 by firmly pressing the member 148 against the second engagement surface 140. The operator can then separate a distal portion of tape 160 from the roll of tape 122 by grasping the distal portion 160 and quickly pulling the distal portion 160 in a general distal direction- Alternatively, if the member 148 comprises a blade, then the contact with the tape 122 would cut the distal portion of the tape from the roll.

Figure 9:
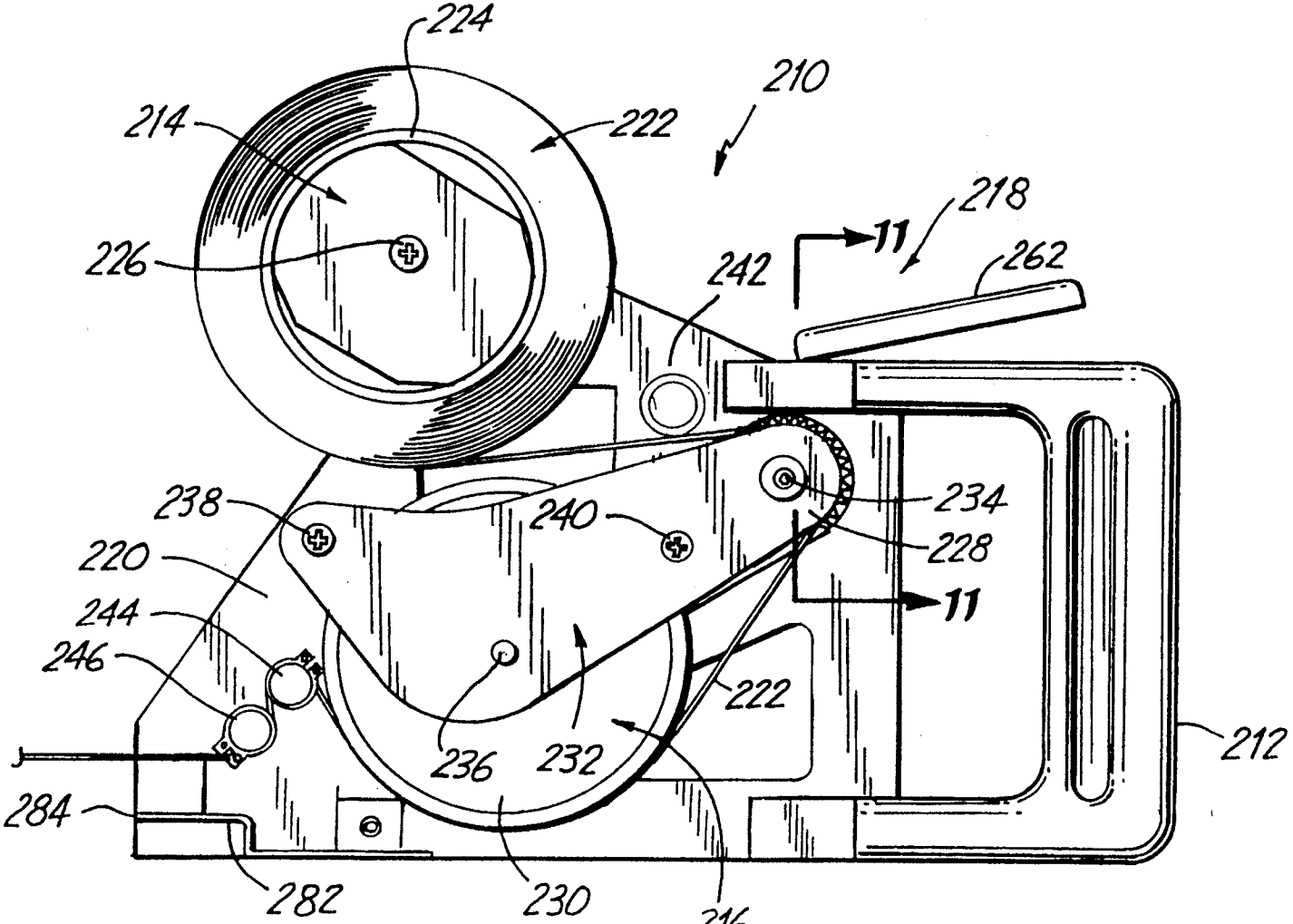
FIG. 9 is a side elevation view of a further alternative embodiment of the present invention.
Figure 10:
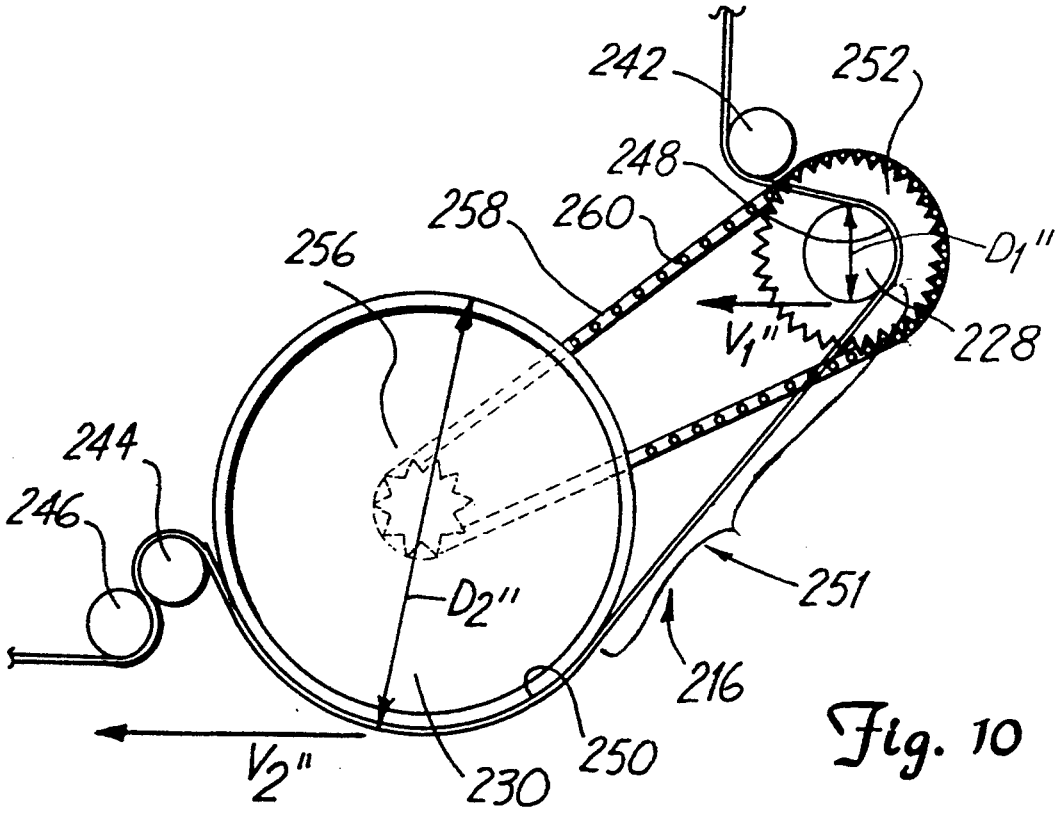
FIG. 10 is an exploded side elevation view of the stretching mechanism of the alternative embodiment presented in FIG. 9.
Figure 11:
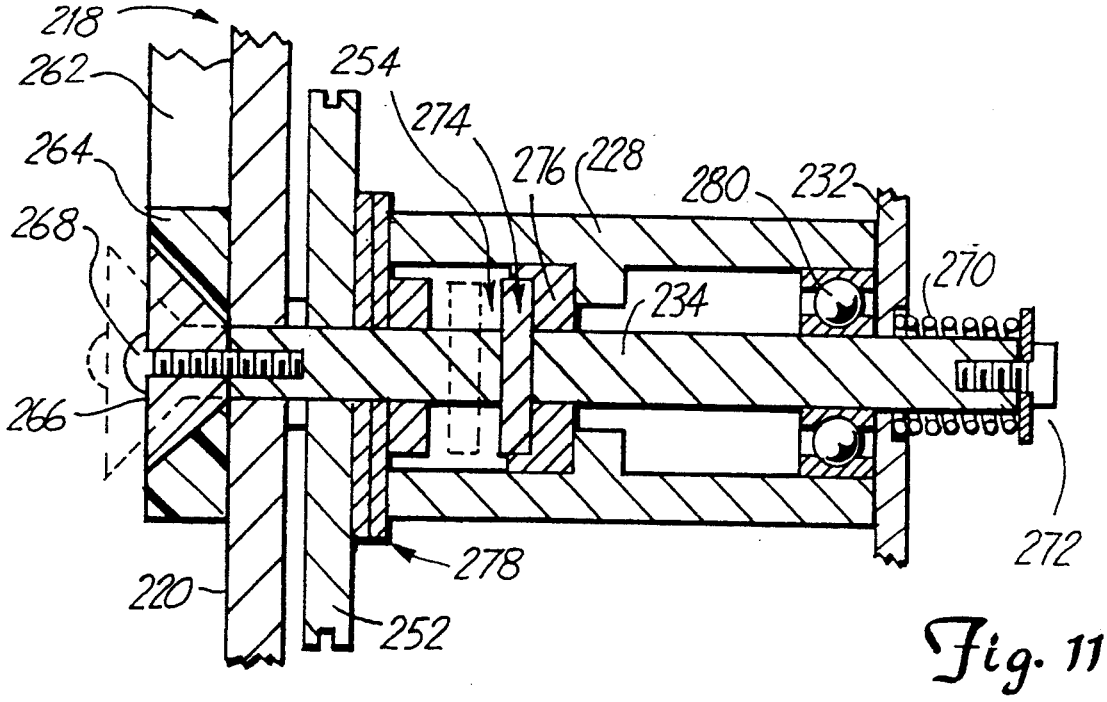
FIG. 11 is a sectional view as taken generally along lines 11—11 of FIG. 9.

FIGS. 9–11 present another alternative embodiment of the present invention. FIG. 9 shows a dispensing apparatus 210 having a handle portion 212, a supply spool 214, a stretching mechanism 216 and a manual activation mechanism 218, all interconnected by a base plate 220. The supply spool 214 is rotatably mounted to the base plate 220 by a supply spool screw 226. A roll of stretchable adhesive tape 222 is preferably disposed on the supply spool 214. The roll has an interior member 224 that frictionally engages with the supply spool 214 such that the roll 222 maintains its position on the supply spool 214 when an operator manipulates the apparatus 210.

As seen best in FIG. 10, the stretching mechanism 216 includes a first roller 228 and a second roller 230 rotatably mounted between the base plate 220 and a roller plate 232 (see FIG. 9) by a first roller pin 234 and a second roller pin 236, respectively. The roller plate 232 provides structural integrity to the dispensing apparatus 210 and is firmly attached to the base plate 220 through roller plate support columns (not shown) by roller plate screws 238 and 240.

FIG. 10 more clearly shows the tape 222 as it passes through the stretching means 216. Idle rollers 242,244 and 246 are conventionally rotatably mounted and positioned on the base plate 220 to guide the tape 222 so that it becomes engaged with a first engagement surface 248 and a second engagement surface 250 disposed on the first roller 228 and the second roller 230, respectively- A stretching zone 251 is defined between the first engagement surface 248 and the second engagement surface 250.

The first roller 228 is normally engaged with a first gear 252 by a clutch mechanism 254 (shown more clearly in FIG. 11 and described in more detail hereinafter). The second roller 230 is connected to a second gear 256. As will be more fully understood from the description below, the connection between the second roller 230 and the second gear 256 could likewise include a clutch mechanism instead of between the first roller 228 and first gear 252. A transfer element 258, such as a belt or chain, connects the first gear 252 and the second gear 256 so the first engagement surface 248 will rotate relative to the second engagement surface 250 when the stretching mechanism is activated. The transfer element 258 preferably has teeth 260 that mesh with the gears 252 and 256. The teeth 260 prevent any slippage from occurring between the belt 258 and the gears 252 and 256. Alternatively, the transfer member 258 could comprise a friction belt or the like and the gears 252 and 256 could comprise frictionally driven pulleys.

As configured, the stretching mechanism 216 works much in the same way as the stretching mechanism 16 previously described in FIGS. 1–5. When the stretching mechanism 216 is activated, the first engagement surface 248 has a first longitudinal velocity V1" and the second engagement surface 250 has a second greater longitudinal velocity V2". Accordingly, the tape 222 disposed within the stretching zone 251 will become elongated. Therefore, an operator can dispense the tape in a stretched condition when the stretching mechanism 216 is activated, i.e. the clutch mechanism 254 is engaged.

The idle rollers 242, 244 and 246 are preferably positioned to increase the area of the tape engagement surfaces 248 and 250. In addition, the difference between the longitudinal velocities V1' and V2' may be adjusted to compensate for any slippage that may occur from any reduced frictional engagement. The following dimensions have been used with this particular embodiment to obtain an optimal amount of elongation of the tape 222 when the frictional engagement surfaces 248 and 250 are smooth metallic surfaces: $D_1''=1.0$ inches, (2.54 cm) $D_2''=3.0$ inches, (7.62 cm) the first gear 252 has 48 teeth and the second gear 256 has 24 teeth.

As seen best in FIG. 11, the operator may selectively activate and deactivate the stretching mechanism 216 via the manual activation mechanism 218. The manual activation mechanism 218 includes a lever arm 262 disposed adjacent the handle 212 and pivotally mounted to the base plate 220 about the first roller pin 234. The lever arm 262 extends downward behind the base plate 220, and has a cam surface 264 which contacts a cammed head 266. The cammed head 266 is attached to the first roller pin 234 by a screw 268. The first gear 252 is firmly attached to the roller pin 234. A compression spring 270 is positioned between an end of the first roller pin 234 and a clip and screw arrangement 272. The spring 270 presses against the roller plate 232 and urges the first roller pin 234 to the right as shown in FIG. 11 so that a first clutch surface 274 connected to the roller pin 234 normally engages with a second clutch surface 276 that is fixed with the first roller 228. Accordingly, as seen in FIG. 11, the clutch 254 is normally in the activated position such that the first roller 228 and the first gear 252 rotate together.

The clutch 254 can be disengaged by the operator by pressing down on the lever arm 262. When the lever arm 262 is pressed down, the cam surface 264 rides against the cammed head 266 in a well known manner to thereby laterally shift the first roller pin 234 against the bias of the spring 270 to a disengaged position. (See dashed lines in FIG. 11.) This action causes the first clutch surface 274 to disengage from the second clutch surface 276 so that the first roller 228 rolls independently from the first gear 252 and the roller pin 234. Washers 278 are preferably disposed between the first gear side surface 252 and the end of the first roller 228 to minimize any friction between the first roller 228 and the first gear 252 when the clutch 254 is deactivated. Bearings 280 are also preferably provided to insure the roller 228 rotates freely about the first roller pin 234 when the clutch 254 is deactivated.

The apparatus 210 allows the operator to dispense the tape 222 in an unstretched condition by simply pressing the lever arm 262 downward- After removing an unstretched portion of tape and adhering that portion to an object, the operator can activate the stretching mechanism by simply releasing the lever arm 262. Accordingly, the tape 222 will exit the apparatus 210 in a prestretched condition. After wrapping the object(s), the operator may deactivate the stretching mechanism 216 to remove an unstretched portion of tape to thereby adhere the tape to an object(s). A cutting member 282 (see FIG. 9), having a cutting blade 284 is also preferably disposed adjacent idle rollers 246 and 244. The cutting blade 284 is positioned such that an operator may easily cut a portion of tape extending beyond the apparatus 210. Other conventional cutting mechanisms are contemplated.

The present invention provides a dispensing apparatus 10, 110, 210, which can utilize the tape in a number of applications. The apparatus 10, 110, 210, is portable and sufficiently small to enable an operator to manipulate the apparatus by using the operator's hands. The apparatus provides manually operative means 18, 110, 218, for selectively stretching the tape 22, 122, 222. In addition, the apparatus also provides stretching means 16, 114, 216, for stretching the tape at a particular elongation rate.

It is also contemplated that the stretching means 16, 114 or 216 could comprise plural stretching zones which in total provide the desired total degree of elongation. For example, a first stretching zone could be provided between first and second rollers and a second zone could be provided between the second roller and a third roller.

Although the present invention has been described with reference to preferred embodiments, workers skilled in the art will recognize that changes may be made in form and detail without departing from the spirit and scope of the invention. For example, all of the embodiments presented herein use a first roller 32, 126, 228, having a smaller diameter than a second roller 34, 132, 230. In addition, all of the embodiments use a transfer means to rotate the second roller faster than the first roller to obtain disparate longitudinal velocities V1, V2, V1′, V2′, V1″, V2″, between a first engagement surface 36, 138, 248, and a second engagement surface 38, 140, 250, respectively. However, one skilled in the art will recognize that disparate longitudinal velocities can also be obtained with rollers having the same diameter and transfer means for rotating the rollers at different rotational speeds. Similarly, disparate longitudinal velocities can also be obtained with rollers rotating at the same speed and having different diameters.

What is claimed is:

1. A portable manual tape dispensing apparatus comprising:

supply means for carrying a supply of stretchable adhesive tape;

a handle connected to the supply means, for manually grasping and manipulating the dispensing apparatus;

stretching means, arranged and configured to receive the tape from the supply means, for stretching the tape, the stretching means including a stretching zone defined between first and second engagement surfaces which frictionally engage the tape, wherein the engagement surfaces move at disparate longitudinal speeds to stretch the tape when the stretching means is activated;

manually operative means for selectively activating the stretching means, whereby an operator can remove the tape from the supply in a unstretched condition when the stretching means is deactivated, and a substantially stretched condition when the stretching means is activated.

2. The apparatus of claim 1 wherein the first and second tape engagement surfaces are disposed on first and second cylindrical rollers respectively.

3. The apparatus of claim 2 wherein a first gear is coupled to the first roller and a second gear is coupled to the second roller, wherein the first gear is pivotally mounted with respect to the second gear such that the first gear and the second gear are engaged when the first gear is in an activated position and the first gear and the second gear are disengaged when the first gear is in a deactivated position.

4. The apparatus of claim 3 wherein the manual operative means includes lever means for selectively engaging the first and second gear.

5. The apparatus of claim 3 wherein the first and second rollers are of different diameters and which rotate at disparate speeds when the first and second gears engage together.

6. The apparatus of claim 3 wherein the first and second rollers rotate in opposite directions.

7. The apparatus of claim 3 further comprising cutting means, disposed adjacent an outlet, for selectively cutting the tape after the tape has exited the apparatus.

8. The apparatus of claim 2 wherein the stretching means includes a first gear surface engaging with the first roller and a second gear surface engaging with the second roller.

9. The apparatus of claim 8 wherein the stretching means includes a transfer element connecting the first gear surface and the second gear surface, for rotating the first gear surface relative to the second gear surface, whereby the first engagement surface rotates relative to the second engagement surface.

10. The apparatus of claim 8 wherein the manually operative means includes a first clutch means for selectively disengaging the first roller and the first gear surface so the first and second rollers rotate independently.

11. The apparatus of claim 8 wherein the manually operative means includes a second clutch means for selectively disengaging the second roller and the second gear surface so the first and second rollers rotate independently.

12. The apparatus of claim 8 further comprising cutting means, disposed adjacent an outlet, for selectively cutting the tape after the tape has exited the apparatus.

13. The apparatus of claim 2 wherein a first gear means is coupled to the first roller and a second gear means is coupled to the second roller, wherein the first and second gear means are engaged together.

14. The apparatus of claim 13 wherein the first and second engagement surfaces are disposed on the apparatus in such a way that the operator may manually deactivate the stretching means by selectively orienting the dispensing apparatus in a nonstretching position such that the tape frictionally engaged with only one of the tape engagement surfaces.

15. The apparatus of claim 14 wherein a portion of the tape extends distally from the apparatus when the apparatus is in a normal stretching position and wherein the operator obtains the nonstretching position from a normal stretching position by rotating the apparatus so that the tape does not frictionally engage with the second roller surface.

16. The apparatus of claim 15 wherein the stretching means is activated and deactivated by rotating the apparatus by about 900.

17. The apparatus of claim 13 wherein the first and second rollers are of different diameters and which rotate at disparate speeds.

18. The apparatus of claim 13 further comprising a cutting means for selectively cutting the tape after the tape has exited the apparatus, the cutting means including a cut-off member pivotally mounted to the apparatus such that the operator may selectively position the cutoff member in a cutting position so a portion of the tape is compressed between an engagement surface and the cut-off members.

19. The apparatus of claim 18 wherein the cut-off member has a cylindrical shape having a knurled exterior surface.

20. The apparatus of claim 1 wherein the tape is stretched to a ratio of 6:1 by the stretching means.

* * * * *